US006314778B1

(12) United States Patent
Moro et al.

(10) Patent No.: US 6,314,778 B1
(45) Date of Patent: Nov. 13, 2001

(54) ROLLING DIE AND SURFACE PROCESSING METHOD FOR ROLLING DIE

(75) Inventors: Toshio Moro; Akihiro Goto, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/657,010

(22) Filed: Sep. 7, 2000

Related U.S. Application Data

(63) Continuation of application No. PCT/JP98/05105, filed on Nov. 13, 1998, now abandoned, and a continuation of application No. PCT/JP98/01137, filed on Mar. 18, 1998, now abandoned.

(51) Int. Cl.[7] ..... B21D 17/04

(52) U.S. Cl. ..... 72/88; 72/469; 76/107.1; 470/185

(58) Field of Search ..... 72/88, 90, 469; 76/107.1; 408/144; 470/185, 187

(56) References Cited

U.S. PATENT DOCUMENTS

| | | | | |
|---|---|---|---|---|
| 3,727,489 | * | 4/1973 | Inoue | 76/107.1 |
| 3,889,516 | * | 6/1975 | Yankee et al. | 72/88 |
| 4,716,751 | * | 1/1988 | Wozniak | 72/88 |
| 5,105,586 | * | 4/1992 | Jenne et al. | 72/88 |
| 5,509,287 | * | 4/1996 | Garden | 72/88 |
| 5,890,852 | * | 4/1999 | Gress | 408/221 |

FOREIGN PATENT DOCUMENTS

| | | |
|---|---|---|
| 61-111740 | 5/1986 | (JP) . |
| 2-46940 | 2/1990 | (JP) . |
| 4-115828 | 4/1992 | (JP) . |
| 5-5246 | 1/1993 | (JP) . |
| 5-508684 | 12/1993 | (JP) . |
| 6-182626 | 7/1994 | (JP) . |
| 8-257841 | 10/1996 | (JP) . |
| 9-19829 | 1/1997 | (JP) . |
| 9-192937 | 7/1997 | (JP) . |
| 9-216023 | 8/1997 | (JP) . |

* cited by examiner

*Primary Examiner*—Ed Tolan
(74) *Attorney, Agent, or Firm*—Sughrue, Mion, Zinn, Macpeak & Seas, PLLC

(57) ABSTRACT

In a rolling die as a tool for thread-rolling screws, an electrode exhaustion-melted substance or its reactive substance of a discharge electrode (5) generated by discharge energy based on an in-liquid gap discharging is adhered to an deposited onto a rolling cutting-edge surface (100*b*). Thus, a hard film (110) of the electrode exhaustion-melted substance or its reactive substance is formed on the rolling cutting-edge surface (100*b*).

13 Claims, 7 Drawing Sheets

(a)

(b)

(a)

(b)

ROLLING DIE AND SURFACE PROCESSING METHOD FOR ROLLING DIE

This is a continuation of International Applications PCT/JP98/01137 and PCT/JP98/05105, with respective international filing dates of Mar. 18 and Nov. 13, 1998, both of which are now abandoned.

TECHNICAL FIELD

The present invention relates to a rolling die and a method of surface-processing a rolling die.

BACKGROUND ART

As dies for thread rolling screws, there are flat dies, round dies, planetary dies, etc. The cutting-edge surface of each die has a complementary shape of a shape of an object to be formed. In the case of thread rolling a screw, the rolling cutting-edge surface has projections of a triangular cross section, with an inclination provided according to a lead angle.

A general rolling die for thread rolling is constructed of a material having hardness of about Rockwell HRC60 in at least the rolling cutting-edge surface, by thermally treating a tool steel or an alloy tool steel.

As the rolling cutting-edge surface has high hardness, generally the cutting-edge surface is finished by grinding with a grindstone of a formed shape. However, as the surface coarseness becomes fine by the grinding, when a rolling die is driven, a phenomenon that a thread-rolled material slides along the rolling die occurs due to a friction between the die and the material at the time of an inverted rotation of the material. Therefore, the rolling cutting-edge surface is roughened by shotblasting, shotpeening or the like after the grinding.

As explained above, it is general that a manufacturing of a rolling die involves many processes such as a formation of a rolling cutting-edge surface by thermal treatment and grinding, and a post-processing (the processing of making the surface rough).

Recently, along with the progress in high-class materials such as automobile parts and other safety bolts, there has been an increase in the hardness of the materials. This is attributable to a severer regulation on the specification of the quality of bolt strength and social requirements for improved strength for performance improvement, etc.

As the hardness of bolt materials increases, the life of the rolling die for thread-rolling screws is necessarily lowered. This makes it necessary to frequently replace rolling dies and regrind the dies after the replacement. Therefore, it is not possible to secure sufficient life of the rolling dies based on the above-described manufacturing method. This has come to lower the productivity and increase costs. Thus, the improvement in bolt strength has come to bring about cost increase more than is necessary.

Conventionally, as a measure for solving this type of problem, the maintenance of necessary strength has been carried out based on selection of materials, thermal treatment, etc. However, under the environment of a further increase in the hardness of materials, it has come impossible to achieve further improvement in the strength of the rolling dies according to the conventional method.

As surface processing methods for improving the strength, there are methods of processing a hard film onto the cutting-edge surface of the die by deposition plating such as CVD (Chemical Vapor Deposition), PVD (Physical Vapor Deposition), etc. However, according to the deposition plating such as the CVD (Chemical Vapor Deposition) or the PVD, the material is treated in a high-temperature furnace during a predetermined period. Even if the hardness is adjusted to a necessary hardness by thermal treatment, a tempered state occurs and the hardness is lowered and the strength is lowered. Therefore, this is not a practical measure.

It is also possible to increase the hardness and strength of the surface of the rolling die for thread-rolling screws and the whole die, by a surface hardening processing such as nitriding or cementation. However, such surface hardening processing has little effect in actual practice in the rolling processing that is a kind of forging where a very large compressive load and smoothing operate.

To cope with this situation, as disclosed in Japanese Patent Publication No. (Hei2-46940), there has been proposed a discharge hardening processing technique for shift dispersing electrode substances of WC, TiC, TaC, etc. onto a rolling cutting-edge surface of a rolling die by intermittently generating a spark discharge based on a contacting and separation between the discharge electrode and the rolling cutting-edge surface, in a state that a discharge voltage is applied between the rolling cutting-edge surface (formed surface) and the discharge electrode that is disposed opposite to the cutting-edge surface.

The surface of a hard film obtained by the above discharge hardening processing becomes in a state that discharge traces have been integrated. Thus, it has been known that a coarse surface is obtained as compared with the ground surface. By only carrying out the discharge hardening processing without carrying out the surface roughing processing such as the shotblasting and the shotpeening, it is possible to obtain the coarseness and hardness (abrasion-proof) that are necessary for the rolling die. It is also possible to omit the provision of fine vertical grooves called a serration into a bite-starting end of a material for the rolling die for ensuring a secure bite of the material.

However, the hard film obtained by the above discharge hardening processing has a too coarse surface. Further, a satisfactory inclination substance area cannot be obtained between the hard film and a base metal. Thus, there is a problem in the strength of the hard film.

Further, the surface coarseness and abrasion-proof required by the rolling cutting-edge surface of the rolling die are not uniform in the rolling direction (a direction from a material bite-starting end toward a rolling finishing end). Naturally, the required surface coarseness and abrasion-proof become maximum at the material bite-starting end where a large processing load is applied. The required surface coarseness and abrasion-proof gradually become lower toward the rolling finishing end.

Regarding the above aspect, according to the conventional rolling die, the hard film is either uniformly provided on the whole surface of the rolling cutting-edge surface of the rolling die or is provided on only a part of the surface. The surface coarseness and the thickness (abrasion-proof) of the hard film formed on the rolling cutting-edge surface are uniform.

Therefore, when the hard film is provided on the rolling cutting-edge surface of the rolling die to have the surface coarseness and thickness that are required at the material bite-starting end, the surface coarseness and thickness are too much at the rolling finishing end. Thus, there arises a waste in the discharge surface processing material and the processing time. Further, when the surface coarseness at the rolling finishing end is the surface coarseness that is required at the material bite-starting end, there is another inconvenience that the surface coarseness of the thread-rolled product becomes coarse.

The present invention has been provided to eliminate the above problems. It is an object of the invention to provide a rolling die and a surface processing method for a rolling die that provide a formation of an excellent hard film on the rolling cutting-edge surface to have high-level hardness and abrasion-proof as a rolling tool, thereby to achieve a long-life rolling tool, without the need for a frequent replacement of dies for manufacturing high-strength bolts, by providing surface coarseness necessary for a rolling die without a special post-processing, and obtain material slide-prevention effect and coarseness of a manufactured product, a reduction in manufacturing cost and a long life of the manufactured product.

DISCLOSURE OF THE INVENTION

This invention can provide a rolling die in a state that an electrode exhaustion-melted substance or its reactive substance of a discharge electrode generated by discharge energy based on a gap discharging in a liquid, has been adhered to and deposited onto a rolling cutting-edge surface of the rolling die, and a hard film of the electrode exhaustion-melted substance or its reactive substance has been formed on the rolling cutting-edge surface.

Therefore, the rolling cutting-edge surface is covered with a hard film of an electrode exhaustion-melted substance or its reactive substance according to a discharge surface processing method based on an in-liquid gap discharging without exposing a rolling die material to a high-temperature atmosphere. Thus, the rolling cutting-edge surface can have high-level abrasion-proof as a rolling tool. Further, based on a collection of sputtered electrode exhaustion-melted substance or its reactive substance, the rolling cutting-edge surface can have surface coarseness necessary for the rolling die. Further, as the rolling cutting-edge surface is formed with the hard film of the electrode exhaustion-melted substance or its reactive substance according to the discharge surface processing method based on the in-liquid gap discharging, a sufficient inclination substance area is formed between the hard film and a base metal. A material boundary is not formed between the hard film and the base material. As a result, it is possible to obtain a rolling cutting-edge surface covered with a hard film having excellent strength.

Further, this invention can provide a rolling die on which a hard film has been formed by an electrode exhaustion-melted substance or its reactive substance of a compressed-powder electrode that has been formed by a compression molding of a hard metal powder, a hard metal hydride powder, or a mixture of these powders and other metal powder or a ceramic material powder.

Therefore, the hard film of a satisfactory quality made of materials including a hard metal and a hard metal hydride or these metals plus other metal or ceramic material, or a reactive substance of these material, can be formed on the rolling cutting-edge surface.

Further, this invention can provide a rolling die in a state that a hard film formed on a rolling cutting-edge surface is made of a metal carbide such as WC, TiC, TaC, ZrC, SiC, VC, etc., or a nitride such as TiN, ZrN, etc., or a boride such as $TiB_2$, $ZrB_2$, etc., or a combination of these components.

Therefore, the rolling cutting-edge surface is covered with a hard film of a satisfactory quality made of a metal carbide such as WC, TiC, TaC, ZrC, SiC, VC, etc., or a nitride such as TiN, ZrN, etc., or a boride such as $TiB_2$, $ZrB_2$, etc., or a combination of these components.

Further, this invention can provide a rolling die in a state that a hard film formed by a discharge surface processing method based on an in-liquid gap discharging has been formed on the whole surface of a rolling cutting-edge surface or only partly on a portion of the rolling cutting-edge surface which is easily abraded.

Therefore, it is possible to obtain the rolling die in a state that a hard film formed by a discharge surface processing method based on an in-liquid gap discharging has been formed on the whole surface of a rolling cutting-edge surface or only partly on a portion of the rolling cutting-edge surface which is easily abraded.

Further, this invention can provide a rolling die in a state that a hard film has been formed on a rolling cutting-edge surface by a discharge surface processing method based on an in-liquid gap discharging, wherein surface coarseness of the hard film is rough at a bite-starting end of a thread-rolled material and the surface coarseness of the hard film is finer toward a rolling finishing end along a rolling direction.

Therefore, this rolling die is provided with suitable surface coarseness without an excess or a shortage in a rolling direction of the rolling cutting-edge surface by a hard film that is formed according to a discharge surface processing method based on an in-liquid gap discharging, and the rolling die can obtain both material slide-prevention effect and surface coarseness of a finished product.

Further, this invention can provide a rolling die in a state that a hard film has been formed on a rolling cutting-edge surface by a discharge surface processing method based on an in-liquid gap discharging, wherein a thickness of the hard film is large at a bite-starting end of a thread-rolled material and the thickness of the hard film is smaller toward a rolling finishing end along a rolling direction.

Therefore, this rolling die is provided with a suitable thickness without an excess or a shortage in a rolling direction of the rolling cutting-edge surface by a hard film that is formed according to a discharge surface processing method based on an in-liquid gap discharging, and the rolling die is provided with abrasion-proof by the hard film without an excess or a shortage along the rolling direction, to have a long life.

Further, this invention can provide a rolling die in a state that a hard film has been formed on a rolling cutting-edge surface by a discharge surface processing method based on an in-liquid gap discharging, wherein the hard film has a multi-layer and multi-type material construction consisting of a primary hard film made of a primary material formed on the rolling cutting-edge surface and a secondary hard film made of a secondary material different from the primary material formed on the primary hard material.

Therefore, a hard film that covers the rolling cutting-edge surface has a multi-function of materials consisting of a primary hard film made of a primary material and a secondary hard film made of a secondary material. Based on a selection of two kinds of materials, the rolling die can have a further improvement in the abrasion-proof to have excellent durability as compared with the rolling die of one-layer construction.

Further, this invention can provide a rolling die wherein the primary hard film is a hard film including a hard metal carbide such as WC, TiC, TaC, ZrC, SiC, VC, etc., and the secondary hard film is a hard film including a self-lubricant metal or a metal compound or Mo, B, N, $MoS_2$, C, $WS_2$, etc.

Therefore, the rolling cutting-edge surface of the rolling die is covered with a hard film of a multi-layer and multi-type material construction consisting of a high-hardness primary hard film including a hard metal carbide such as WC, TiC, TaCZrC, SiC, VC, etc., and a self-lubricant (solid lubricant) secondary hard film including a self-lubricant metal or a metal compound or Mo, B, N, $MoS_2$, C, $WS_2$, etc. The rolling die can have a further improvement in the abrasion-proof to have excellent durability as compared with the rolling die of one-layer construction.

Further, this invention can provide a surface processing method for a rolling die comprising the steps of: generating a discharging between a rolling die material and a discharge electrode, with the rolling die material and the discharge electrode disposed opposite to each other keeping a predetermined discharge gap therebetween in a processing liquid; having an electrode exhaustion-melted substance or its reactive substance generated by discharge energy adhered to and deposited onto a rolling cutting-edge surface of the rolling die; and forming a hard film of the electrode exhaustion-melted substance or its reactive substance on the rolling cutting-edge surface.

Therefore, it is possible to manufacture a rolling die having the rolling cutting-edge surface covered with a hard film of an electrode exhaustion-melted substance or its reactive substance according to a discharge surface processing method based on an in-liquid gap discharging without exposing a rolling die material to a high-temperature atmosphere. Thus, the rolling cutting-edge surface can have high-level abrasion-proof as a rolling tool. Further, based on a collection of sputtered electrode exhaustion-melted substance or its reactive substance, it is possible to manufacture a rolling die having surface coarseness necessary for the rolling die on the rolling cutting-edge surface. Further, as the rolling cutting-edge surface is formed with the hard film of the electrode exhaustion-melted substance or its reactive substance according to the discharge surface processing method based on the in-liquid gap discharging, a sufficient inclination substance area is formed between the hard film and a base metal. A material boundary is not formed between the hard film and the base material. As a result, it is possible to cover the rolling cutting-edge surface with a hard film having excellent strength.

Further, this invention can provide a surface processing method for a rolling die using as a discharge electrode a compressed-powder electrode that has been formed by a compression molding of a hard metal powder, a hard metal hydride powder, or a mixture of these powders and other metal powder or a ceramic material powder.

Therefore, the hard film of a satisfactory quality made of materials including a hard metal and a hard metal hydride or these metals plus other metal or ceramic material, or a reactive substance of these material, can be formed on the rolling cutting-edge surface.

Further, this invention can provide a surface processing method for a rolling die using as a discharge electrode a compressed-powder electrode that has been formed by a compression molding of a powder material including a metal carbide such as WC, TiC, TaC, ZrC, SiC, VC, etc., or a nitride such as TiN, ZrN, etc., or a boride such as $TiB_2$, $ZrB_2$, etc.

Therefore, the rolling cutting-edge surface is covered with a hard film of a satisfactory quality made of a metal carbide such as WC, TiC, TaC, ZrC, SiC, VC, etc., or a nitride such as TIN, ZrN, etc., or a boride such as $TiB_2$, $ZrB_2$, etc., or a combination of these components.

Further, this invention can provide a surface processing method for a rolling die for forming a hard film using as a discharge electrode a compressed-powder electrode that has been formed by a compression molding of a hard metal powder such as Ti, Zr, V, Nb, Ta, etc., or a powder of these hydrides, or a metal electrode using these metals, and using a discharge processing oil including HC as a processing liquid.

Therefore, based on a reaction between an electrode material and a discharge processing oil including HC, a hard film of metal carbide such as TiC, ZrC, VC, NbC, TaC, etc. is formed on a rolling cutting-edge surface.

Further, this invention can provide a surface processing method for a rolling die for forming a hard film on the whole surface of a rolling cutting-edge surface or only partly on a portion of the rolling cutting-edge surface which is easily abraded, by a discharge surface processing method based on an in-liquid gap discharging.

Therefore, it is possible to manufacture a rolling die in a state that a hard film formed by a discharge surface processing method based on an in-liquid gap discharging has been formed on the whole surface of a rolling cutting-edge surface or only partly on a portion of the rolling cutting-edge surface which is easily abraded.

Further, this invention can provide a surface processing method for a rolling die for forming a hard film of an electrode exhaustion-melted substance on a rolling cutting-edge surface having ribbed projections by generating a discharge between a rolling die material and a discharge electrode based on a relative movement between the discharge electrode and the rolling die material along a projected longitudinal direction of the rolling cutting-edge surface.

Therefore, it is possible to efficiently form a hard film of uniform quality on a rolling cutting-edge surface without carrying out a pitch feeding in a lateral direction, by only making a relative movement between a discharge electrode and a rolling die material along a projected longitudinal direction of the rolling cutting-edge surface.

Further, this invention can provide a surface processing method for a rolling die for forming a hard film of an electrode exhaustion-melted substance or its reactive substance on a rolling cutting-edge surface by maintaining a processing condition that a shape of the rolling cutting-edge surface of a rolling die material is copied onto an opposite surface of a discharge electrode along the progress of a formation of a hard film based on the electrode exhaustion-melted substance or its reactive substance generated by a discharging between the rolling die material and the discharge electrode, with the discharge electrode having a plane surface as an initial shape facing the rolling die material, and the discharge electrode having a predetermined width in a relative movement direction with respect to the rolling die material.

Therefore, by using a discharge electrode having a simple shape like a block shape, it is possible to efficiently form a hard film of uniform quality on a rolling cutting-edge surface without carrying out a pitch feeding in a lateral direction, by only making a relative movement between the discharge electrode and a rolling die material along a projected longitudinal direction of the rolling cutting-edge surface.

Further, this invention can provide a surface processing method for a rolling die for making rough surface coarseness of a hard film at a bite-starting end of a thread-rolled material and making finer surface coarseness of the hard film toward a rolling finishing end along a rolling direction.

Therefore, it is possible to obtain a rolling die provided with suitable surface coarseness without an excess or a shortage in a rolling direction of a rolling cutting-edge surface by a hard film generated according to a discharge surface processing method based on an in-liquid gap discharging, and achieving both material slide-prevention effect and surface coarseness of a finished product.

Further, this invention can provide a surface processing method for a rolling die for making rough surface coarseness of a hard film at a bite-starting end of a thread-rolled material and making finer surface coarseness of the hard film toward a rolling finishing end along a rolling direction, by setting a high discharge processing current at the bite-starting end of the thread-rolled material and setting a lower discharge processing current toward the rolling finishing end along the rolling direction.

Therefore, by controlling a discharge processing current, it is possible to obtain a rolling die provided with suitable surface coarseness without an excess or a shortage in a rolling direction of a rolling cutting-edge surface by a hard film generated according to a discharge surface processing method based on an in-liquid gap discharging, and achieving both material slide-prevention effect and surface coarseness of a finished product. Further, it is also possible to reduce power consumption in the discharge processing and to lower manufacturing cost.

Further, this invention can provide a surface processing method for a rolling die for making a large thickness of a hard film at a bite-starting end of a thread-rolled material and making a smaller thickness of the hard film toward a rolling finishing end along a rolling direction.

Therefore, it is possible to provide a rolling die having a suitable thickness without an excess or a shortage in a rolling direction of a rolling cutting-edge surface by a hard film that is generated according to a discharge surface processing method based on an in-liquid gap discharging, and having abrasion-proof by the hard film without an excess or a shortage along the rolling direction, to have a long life. Further, it is also possible to decrease discharge-processing time and to lower manufacturing cost.

Further, this invention can provide a surface processing method for a rolling die for making a large thickness of a hard film at a bite-starting end of a thread-rolled material and making a smaller thickness of the hard film toward a rolling finishing end along a rolling direction, by setting a low feeding speed at the bite-starting end of the thread-rolled material and setting an increased feeding speed toward the rolling finishing end along the rolling direction.

Therefore, by controlling the feeding speed, it is possible to provide a rolling die having a suitable thickness without an excess or a shortage in a rolling direction of a rolling cutting-edge surface by a hard film that is generated according to a discharge surface processing method based on an in-liquid gap discharging, and having abrasion-proof by the hard film without an excess or a shortage along the rolling direction, to have a long life. Further, it is also possible to decrease discharge-processing time and to lower manufacturing cost.

Further, this invention can provide a surface processing method for a rolling die for covering a rolling cutting-edge surface with a hard film of a multi-layer and multi-type material construction by first forming a primary hard film made of a primary material on the rolling cutting-edge surface using a discharge electrode for forming a primary material hard film, and thereafter forming a secondary hard film made of a secondary material on the primary hard material using a discharge electrode for forming a secondary material hard film different from the primary material.

Therefore, a hard film that covers a rolling cutting-edge surface can have a multi-function of materials consisting of a primary hard film made of a primary material and a secondary hard film made of a secondary material. Based on a selection of these two kinds of materials, it is easily possible to obtain a rolling die excellent in durability in the hard film with further improvement in the abrasion-proof as compared with the rolling die of one-layer construction.

Further, this invention can provide a surface processing method for a rolling die for carrying out a discharge surface processing for forming the secondary hard film using a discharge electrode including a self-lubricant metal or a metal compound or Mo, B, N, $MoS_2$, C, $WS_2$, etc. in a processing liquid using oil as a main component.

Therefore, a rolling cutting-edge surface is covered with a self-lubricant secondary hard film including a carbide of a self-lubricant metal or a metal compound or Mo, B, N, $MoS_2$, C, $WS_2$, etc., and an oil of a processing liquid. It is thus possible to obtain a rolling die with further improvement in the abrasion-proof as compared with the rolling die of one-layer construction.

Further, this invention can provide a surface processing method for a rolling die for carrying out a discharge surface processing for forming the secondary hard film using a discharge electrode including a self-lubricant metal or a metal compound or Mo, B, N, $MoS_2$, C, $WS_2$, etc. in a processing liquid using water as a main component.

Therefore, a rolling cutting-edge surface is covered with a self-lubricant secondary hard film based on a self-lubricant discharge material itself including a self-lubricant metal or a metal compound or Mo, B, N, $MoS_2$, C, $WS_2$, etc. It is thus possible to obtain a rolling die with further improvement in the abrasion-proof as compared with the rolling die of one-layer construction.

BEST MODE FOR CARRYING OUT THE INVENTION

Preferred embodiments relating to this invention will be explained with reference to the attached drawings.

Figure 1:
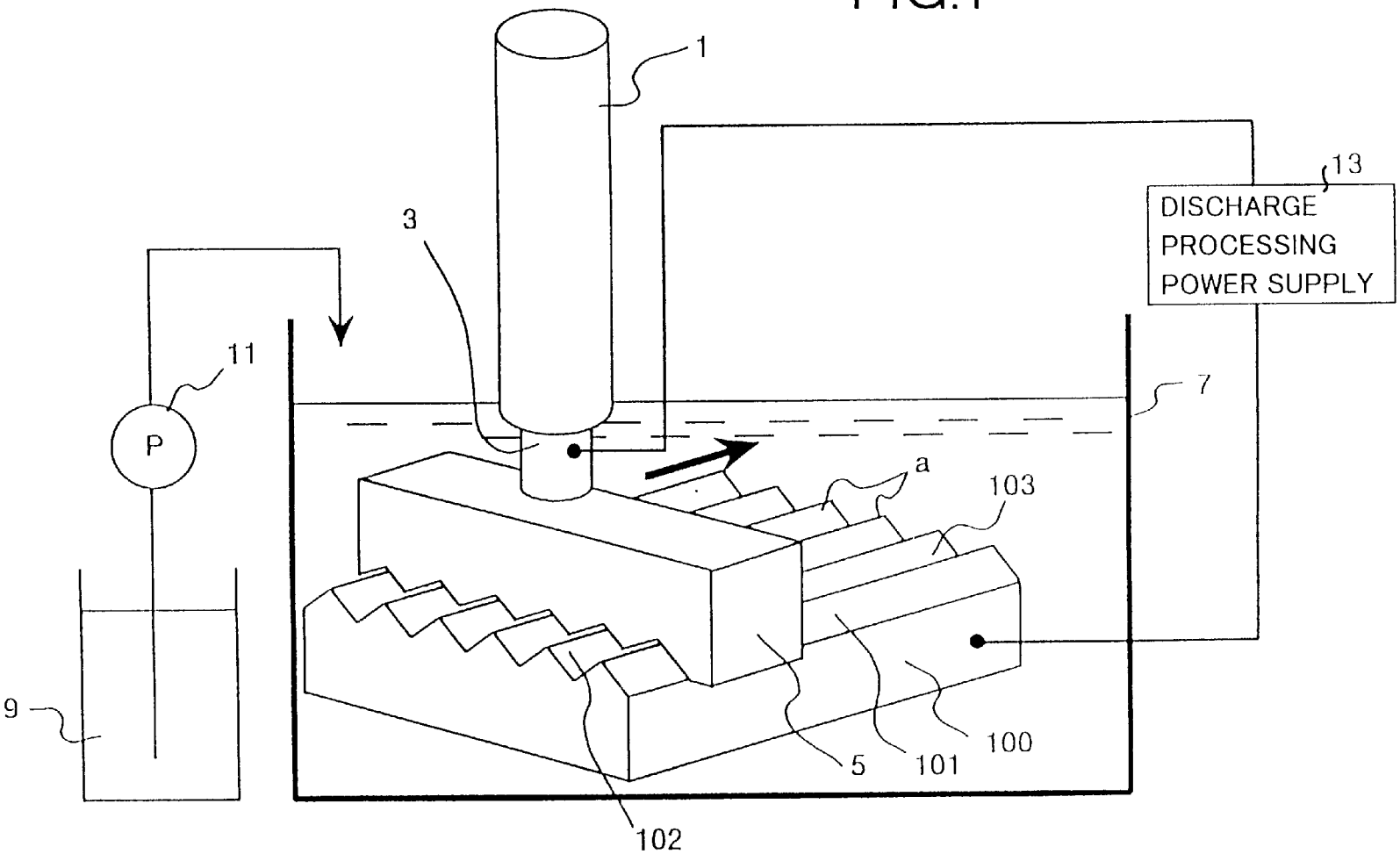
FIG. 1 is a schematic construction perspective view showing a discharge-processing unit used for implementing a surface processing method for a rolling die according to the present invention.

FIG. 1 shows a discharge-processing unit used for implementing a surface processing method for a rolling die according to this invention. This discharge-processing unit may be a general discharge-processing unit. A discharge electrode 5 is fitted in a replaceable state to a vertically movable electrode-supporting axis 1 with a shank 3.

A rolling die material (a flat die) 100 to be processed is disposed in a processing bath 7. The rolling die material 100 shown is a die for thread rolling a screw. A rolling cutting-edge surface 101 has many projections a, each having a triangular cross section provided with an inclination angle θ according to a screw lead angle (reference FIG. 2).

A processing liquid is injected into the processing bath 7 from a processing liquid tank 9 by a pump 11. The processing liquid is stored in the processing bath 7, and the rolling die material 100 is dipped into the processing liquid.

A voltage is applied in pulse to between the discharge electrode 5 and the rolling die material 100 by a discharge processing power supply 13. In the processing liquid, a discharge gap of about 10 to a few dozens $\mu$ is given to between the discharge electrode 5 and the rolling die material 100 by a vertical feeding of the electrode supporting axis 1. In other words, the discharge electrode 5 and the rolling die material 100 face each other with a predetermined discharge gap left therebetween, thereby to generate a pulsate discharging between the rolling die material 100 and the discharge electrode 5.

Figure 2:
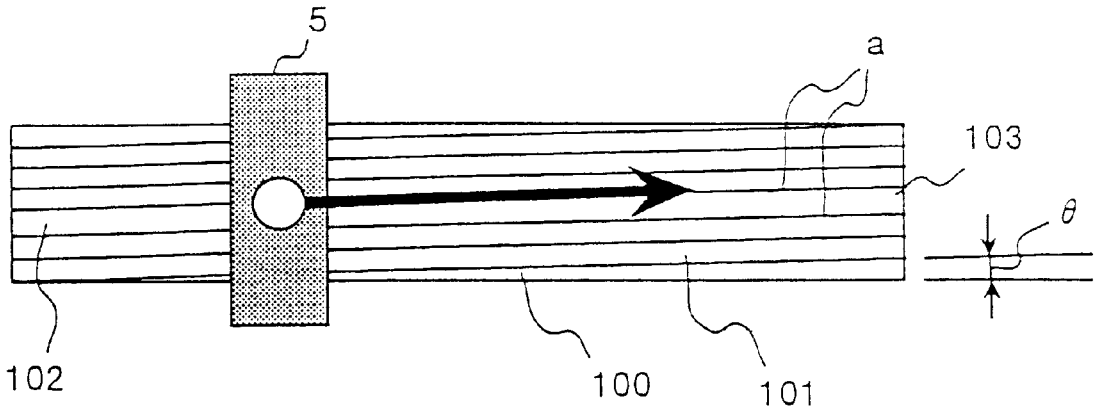
FIG. 2 is a top plan view showing one embodiment of the surface processing method for a rolling die according to this invention.

As shown in FIG. 2, the discharge electrode 5 and the rolling die material 100 are moved relatively in a longitudinal direction of the ribbed projections a inclined at the inclination angle θ, to generate a pulsate discharging between the rolling die material 100 and the discharge electrode 5 as described above.

Based on discharge energy of this discharging, a large volume of a sputtered electrode exhaustion-melted substance or its reactive substance is generated, and this adheres to and is deposited onto a rolling cutting-edge surface 101 of the rolling die material 100. As a result, a hard film 110 of the electrode exhaustion-melted substance is formed on the rolling cutting-edge surface 101, as shown in FIG. 3s.

The above-described method of forming the hard film 110 by pulse discharging is based on a method called a discharge surface processing method according to an in-liquid gap discharging. This discharge surface processing method is disclosed in Japanese Patent Application Laid-open Publication No. Hei 6-182626, Japanese Patent Application Laid-open Publication No. Hei 8-257841, Japanese Patent Application Laid-open Publication No. Hei 9-19829, and Japanese Patent Application Laid-open Publication No. Hei 9-192937, respectively.

According to this discharge surface processing method, for the discharge electrode 5, it is possible to use a compressed-powder electrode that has been formed by a compression molding of a hard metal powder, a hard metal hydride powder, or a mixture of these powders and other metal powder or a ceramic material powder.

Specifically, it is possible to use a compressed-powder electrode that has been formed by a compression molding of a powder material including a metal carbide such as WC, TiC, TaC, ZrC, SiC, VC, etc., or a nitride such as TiN, ZrN, etc., or a boride such as $TiB_2$, $ZrB_2$, etc.

Further, for the discharge electrode, it is possible to use a compressed-powder electrode that has been formed by a compression molding of a hard metal powder such as Ti, Zr, V, Nb, Ta, etc., or $TiH_2$ (titanium hydride), or a powder of these hydrides, or a metal electrode based on these metals, and to use a discharge processing oil including HC as a processing liquid.

When a discharging is generated between a discharge electrode made of a material forming a hard metal carbide such as TiC, etc. and a metal material (a rolling die material) to be processed, it is possible to form a strong hard film without a process of re-melting on the surface of the rolling cutting-edge surface 101 of the rolling die material 100 as the thread-rolled material.

Further, when a discharging is generated between a compressed-powder electrode of a metal hydride such as $TiH_2$, etc. and a metal material as a thread-rolled material without the presence of a processing liquid therebetween, it is possible to form a hard film with satisfactory adhesiveness faster than when using the material of Ti or the like.

Further, when a discharging is generated between a compressed-powder electrode prepared by a mixture of a hydride such as $TiH_2$ and other metal or ceramic and a metal material as a thread-rolled material, it possible to form quickly a hard film having various characteristics such as hardness, abrasion-proof, etc.

In the case of a compressed-powder electrode using $TiH_2$, the compressed-powder electrode $TiH_2$ is exhausted by the energy of discharging. A hard film of Ti as a main component of this electrode reacts with a carbon component of the processing liquid, and this adheres to the rolling cutting-edge surface 101 of the rolling die material 100, thereby forming a hard film of TiC.

This hard film has very high hardness and can obtain Vickers hardness of HV=about 2500 to 3000. Further, this has extremely high adhesives strength, and it has been known from acoustic clutch tests that this has strength at which an acoustic signal showing a break cannot be detected. Further, as this hard film is formed by a discharge surface processing method based on an in-liquid gap discharging, the surface is in a state that discharge traces of a suitable size have been integrated. Based on the collection of sputtered electrode exhaustion-melted substance, the surface presents a shape similar to that obtained when a shotblasting has been conducted. The surface presents a surface coarseness of, for example, about 10 to 15 $\mu$mRmax. As a result, the rolling cutting-edge surface 101 naturally has a surface coarseness necessary for the rolling die.

As explained above, as a discharge surface processing based on an in-liquid gap discharging has been carried out to the rolling cutting-edge surface 101 of the rolling die material 100, an excellent hard film is formed on the rolling cutting-edge surface 101 based on the electrode exhaustion-melted substance or its reactive substance without exposing the rolling die material to a high-temperature atmosphere. Thus, the rolling cutting-edge surface has hardness and abrasion-proof necessary for the rolling tool to have a long life. Thus, it is possible to obtain a rolling die that does not require a frequent replacement of dies in the manufacturing of high-strength bolts and that can have surface coarseness necessary for the rolling die without carrying out a special post-processing. In the rolling processing, a thread-rolled product does not slip easily on the rolling die. As a result, it is possible to manufacture a product in high precision and with satisfactory finish surface coarseness.

Further, when a discharging is generated between the rolling die material 100 and the discharge electrode 5 by making a relative movement between the discharge electrode 5 and the rolling die material 100 in the longitudinal direction of the ribbed projections a with an inclination at the inclination angle θ, the discharge electrode 5 and the rolling cutting-edge surface 101 of the rolling die material 100 face each other always in parallel. Therefore, the exhaustion of the discharge electrode 5 is limited to only a thickness direction.

When this method is not used, it is necessary to carry out a discharge surface processing for each width of the discharge electrode, and to feed the electrode-supporting axis to fall it by shifting the discharge electrode by the width of the discharge electrode. This process is repeated in sequence along the longitudinal direction of the rolling die material. Each time when the discharge electrode is shifted, it is necessary to correct a deviation of the shift direction and the right-angle direction.

In other words, as a new surface of the discharge electrode faces the rolling die material along the shift of the shape of this material, it is necessary to deviate by a lead pitch between a cutting-edge surface and a cutting-edge surface. This method of lifting the electrode supporting axis and forwarding the pitch in the lateral direction by the width of the discharge electrode involves a very complex procedure.

On the other hand, in the case of the method of generating a discharge between the rolling die material 100 and the discharge electrode 5 by making a relative movement between the discharge electrode 5 and the rolling die material 100 in the longitudinal direction of the ribbed projections a with an inclination at the inclination angle θ, it is possible to carry out the discharge surface processing efficiently in an extremely stable state without vertically moving the electrode supporting axis and without forwarding the pitch by the width of the discharge electrode.

According to the embodiment shown in FIG. 1, the discharge electrode 5 is shaped in a form that follows the mounting shape of the rolling cutting-edge surface 101 of the rolling die material 100, and the processing is proceeded. However, it is not essential to shape the electrode to match the shape of the facing member before starting the processing.

When the discharge electrode 5 facing the rolling cutting-edge surface 101 of the rolling die material 100 is exhausted along the progress of the processing of the discharge surface processing, the discharge electrode is exhausted following the shape of the rolling cutting-edge surface 101, and this is convenient.

A compressed-powder electrode that has been formed by a compression molding of a metal powder, or a metal compound powder, or a ceramic material powder is characterized in that it is extremely exhausted at a higher rate than an electrode material that is used for a general discharge processing. The exhaustion progresses along the progress of the processing, and follows the shape of the rolling cutting-edge surface 101. With this arrangement, it is possible to carry out a discharge surface processing using an electrode of a simple plane structure without forming a front end of the discharge electrode before the processing. Thus, it is possible to omit the process of processing the discharge electrode.

Figure 4:
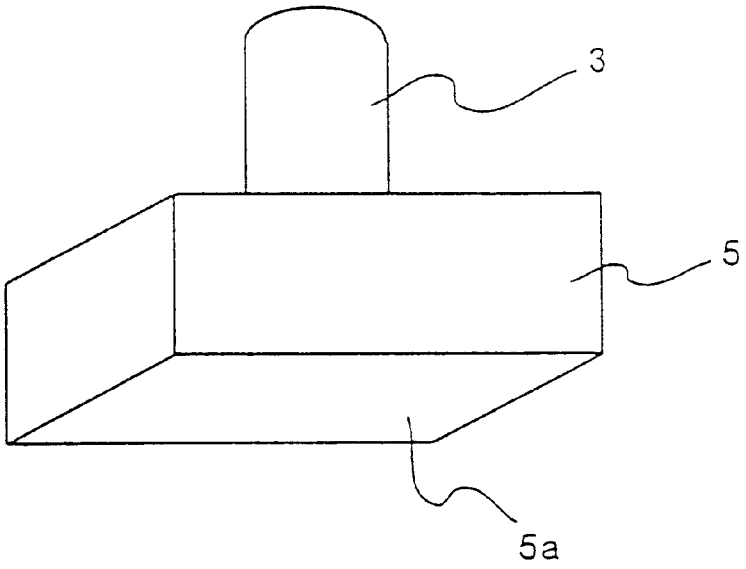
FIG. 4 is a perspective view showing a discharge electrode used for implementing the surface processing method for a rolling die according to the present invention.

Specifically, as shown in FIG. 4, the initial shape of a surface 5*a* facing the rolling die material 100 of the discharge electrode 5 is set plane, and the discharge electrode 5 has a block shape with a predetermined width in a direction of a relative movement with the rolling die material. A hard film of the electrode exhaustion-melted substance is formed on the rolling cutting-edge surface 101 by maintaining a processing condition that the shape of the rolling cutting-edge surface 101 of the rolling die material 100 is copied onto the opposite surface 5*a* along the progress of the formation of a hard film of the electrode exhaustion-melted substance that is generated by the discharging between the rolling die material 100 and the discharge electrode 5.

The above discharge electrode can be commonly applied to any rolling object. The effect of omitting the process of forming the discharge electrode becomes larger when the facing member is more complex. Generally, it is extremely difficult to process the front end of the discharge electrode to match the shape of a screw or the like. Precision, processing time and positioning become large problems. When a discharge electrode having a plane initial shape is used, it is possible to implement positioning relatively easily, and the processing efficiency can be improved substantially.

Figure 3:
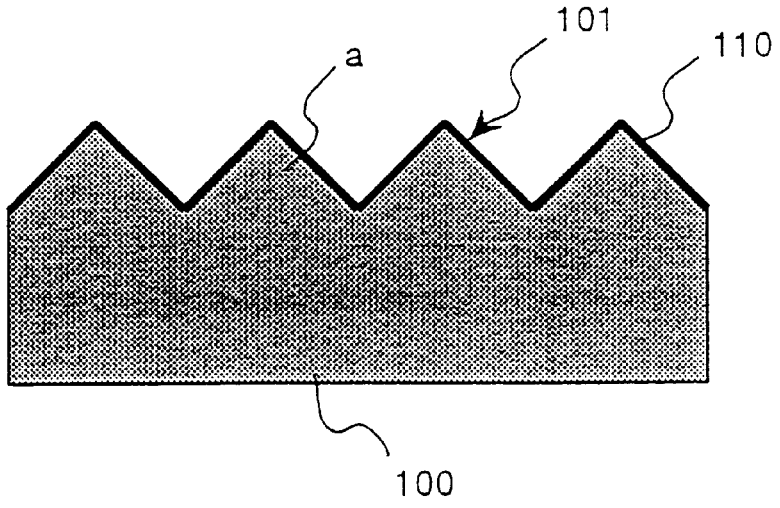
FIG. 3 is an enlarged cross-sectional view showing key parts of a rolling die according to the present invention.
Figure 5:
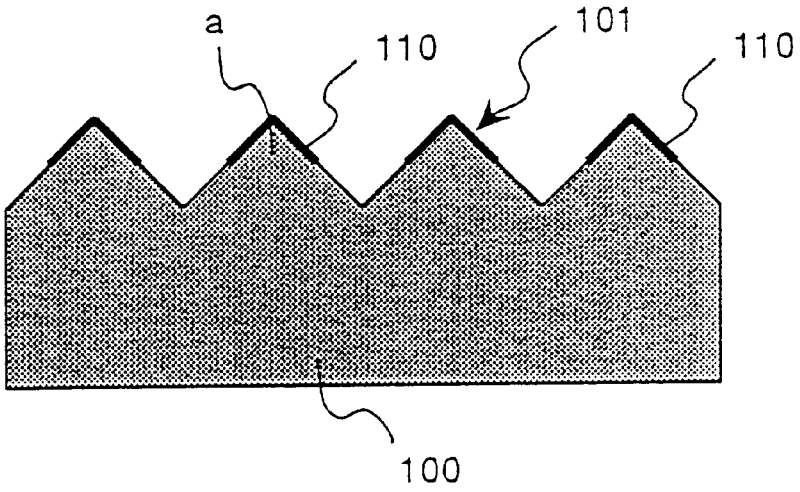
FIG. 5 is an enlarged cross-sectional view showing another example of key parts of a rolling die according to the present invention.

The hard film 110 may be partly formed on a portion of the rolling cutting-edge surface 101 that is easily abraded, such as on only a crest of each projection a of the rolling cutting-edge surface 101, as shown in FIG. 5, instead of forming the hard film on 110 the whole surface of the rolling cutting-edge surface 101 as shown in FIG. 3.

When the discharge electrode 5 is proceeded by progressing the discharge surface processing in an arrow direction in FIG. 2, at the beginning, a discharging occurs only near the crest of each thread as the bottom surface of the discharge electrode 5 is in a plane shape. The discharge surface processing is not carried out to cover the whole threads at one time, but is limited to only positions near the crests. As the discharge surface processing progresses, the exhaustion of the discharge electrode 5 also progresses, and a discharging occurs over the whole threads. As a result, the hard film 110 covers the whole threads as shown in FIG. 2.

In observing the process of thread-rolling a screw, a flexible large load is first integrally applied to near the crests of the threads of the rolling cutting-edge surface 101, and a large load is not applied to portions corresponding to bottoms of screw threads of the plane die.

This means that it is not necessary to cover the whole surface of the screw threads of the plane die with a hard film, but it is rather sufficient to cover the hard film on only necessary portions. It has been known that the shapes of the threads of the plane die are gradually worn away by a load of large flexible deformation but the abrasion at the portions of the bottom of the gorge is not progressed.

In other words, when the bottom surface of the discharge electrode 5 has a plane shape at the beginning and a discharging occurs on only the crests, this does not become a practically large hindrance. Therefore, it is not necessary to process the discharge electrode to match it with the facing member from the beginning, and it is sufficient to process with the discharge electrode of a simple shape.

This makes it possible to reduce the processing time and to cut processing cost as well as substantially decreasing cost of manufacturing the electrode.

In the above embodiment, the plane die has been explained. However, the rolling die and the surface processing method for a rolling die of the present invention can be similarly applied to a round die and a planetary die as well, without limiting the application to the plane die.

In the case of a rotary die such as a round die and a planetary die, the rolling cutting-edge surface has a circumferential surface. The discharge electrode and the rolling die material are relatively displaced in rolling along this circumferential surface.

Unlike the plane die that makes a parallel movement, the rotary die executes a rolling-forming in rotation. Therefore, the speed-up is easy and the productivity is high, and thus, this rotary die has been widely applied for the formation of small-diameter bolts and the like. A discharge surface processing method for a rotary die can be applied in a similar manner to that of the plane die. However, the method requires making device as the die is a rotary unit.

Figure 6:
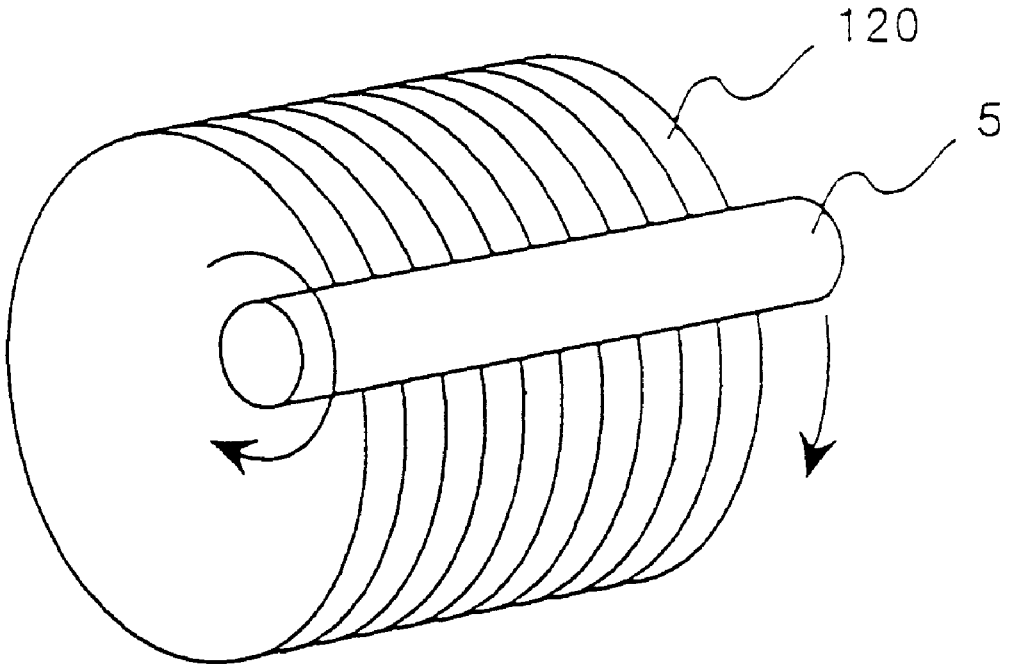
FIG. 6 is a perspective view showing an embodiment of applying the surface processing method for a rolling die according to the present invention to a rolling die.

In the case of processing a rotary die, as shown in FIG. 6, a discharge electrode 5 is rotated along the circumference of a rotary die 120 using a cylindrical discharge electrode 5. A feed in a radial direction of the discharge electrode 5 is given in synchronism with the rotation, thereby to execute the discharge surface processing. In this case, it is not necessary to match the peripheral shape of the discharge electrode 5 with the shape of the facing member in advance either.

Instead of moving the discharge electrode 5 along the periphery of the rotary die 120 with the rotary die 120 fixed, the discharge surface processing of the rotary die 120 can be carried out by making a rotary displacement of the rotary die 120 around its center axis line along the discharge electrode 5, without changing a core axis position of the discharge electrode, and giving a radial-directional displacement of the rotary die 120 in synchronism with the rotary displacement.

Further, in the plane die, it is possible to arrange such that the surface coarseness of the hard film 110 of the rolling cutting-edge surface 101 is most rough at a bite-starting end 102 of a thread-rolled material and the surface coarseness is finer toward a rolling finishing end 103 along the rolling direction, thereby providing a suitable surface coarseness on the rolling cutting-edge surface 101 without an excess or a shortage in the rolling direction by the hard film 110 according to the discharge surface processing.

In the discharge surface processing method based on an in-liquid gap discharging, the surface coarseness can be controlled according to a discharge processing condition. For increasing the surface coarseness, a large processing current is flown. For decreasing the surface coarseness, a small current is flown.

Therefore, for setting the surface coarseness of the hard film 110 of the rolling cutting-edge surface 101 most rough at the bite-starting end 102 of the thread-rolled material and setting the surface coarseness finer toward the rolling finishing end 103 along the rolling direction, the discharge surface processing is carried out by a variable control of a discharge processing current such that the discharge processing current is set high at the bite-starting end 102 of the thread-rolled material and the discharge processing current is set gradually lower toward the rolling finishing end 103 along the rolling direction.

Based on the above-described discharge surface processing method according to the variable discharge processing current control, it is possible to obtain a rolling die in a state that the surface coarseness of the hard film is most rough at the bite-starting end 102 of a thread-rolled material and the surface coarseness of the hard film is gradually continuously finer toward the rolling finishing end 103 along the rolling direction.

With the above arrangement, the rolling die is suitably provided with the coarseness on the rolling cutting-edge surface 101 by the hard film 110 without an excess or a shortage in the rolling direction according to the discharge surface processing method. Thus, it is possible to obtain both the material slide-prevention effect and the surface coarseness of the thread-rolled product.

As explained above, as the surface coarseness of the hard film 110 can be easily controlled by controlling the current of the discharge surface processing, a continuous processing can be conducted to obtain a rough surface to a fine surface. The sliding of the material at the manufacturing time can be restricted, and the life of the die can be improved substantially. At the same time, power consumption in the discharge processing can be decreased, and manufacturing cost can be lowered.

Further, as the surface coarseness of the bite-starting end 102 of the thread-rolled material can be made sufficiently rough separately from the surface coarseness of the rolling finishing end 103, it is not necessary to provide auxiliary means for the biting called a serration into the bite-starting end 102 of the thread-rolled material.

Conventionally, the serration processing for the bite has been determined experimentally, and there is no quantitative processing condition. Therefore, the serration processing has been a cause of a variation in quality between rolling dies. The serration processing has problems in that it changes the life of the rolling die substantially and that a promoted wearing of the cutting edge is induced by the serration. The abolition of the serration solves all of these problems at once. Further, as the surface coarseness of the rolling finishing end 103 is set fine separately from the surface coarseness of the bite-starting end 102 that does not require the serration, the surface coarseness of the thread-rolled product is not rough. Thus, it becomes possible to manufacture a high-quality product.

As the surface coarseness control can be done easily by controlling the current of the discharge surface processing, the preparation of a processing program makes it possible to automatically process without generating variations among rolling dies. Therefore, this does not generate a situation of an occurrence of variations in the performance of dies depending on workers who operate based on experience as has been the case in the past. When the processing of the serration of the rolling die is abolished, the processing time can be cut, and the quality is stabilized. As a result, productivity and life can be stabilized. In total, effective utilization of dies can be promoted.

Further, in the plane die, it is possible to arrange such that the thickness of the hard film 110 of the rolling cutting-edge surface 101 is largest at the bite-starting end 102 of the thread-rolled material and the film thickness is smaller toward the rolling finishing end 103 along the rolling direction, thereby providing suitable abrasion-proof without an excess or a shortage in the rolling direction by the hard film 110 according to the discharge surface processing.

In the discharge surface processing method based on the in-liquid gap discharging, the film thickness can be controlled according to a discharge processing condition. For forming a large film thickness, a relative move speed between the discharge electrode 5 and the rolling die material 100, that is, the feeding speed, is made slower. For forming a small film thickness, the feeding speed is lowered.

Therefore, for setting the hard film 110 of the rolling cutting-edge surface 101 to have a largest thickness at the bite-starting end 102 of the thread-rolled material and setting a smaller film thickness toward the rolling finishing end 103 along the rolling direction, the discharge surface processing is carried out by a variable control of the feeding speed such that the feeding speed is set low at the bite-starting end 102 of the thread-rolled material and the feeding speed is set gradually higher toward the rolling finishing end 103 along the rolling direction.

Figure 7:
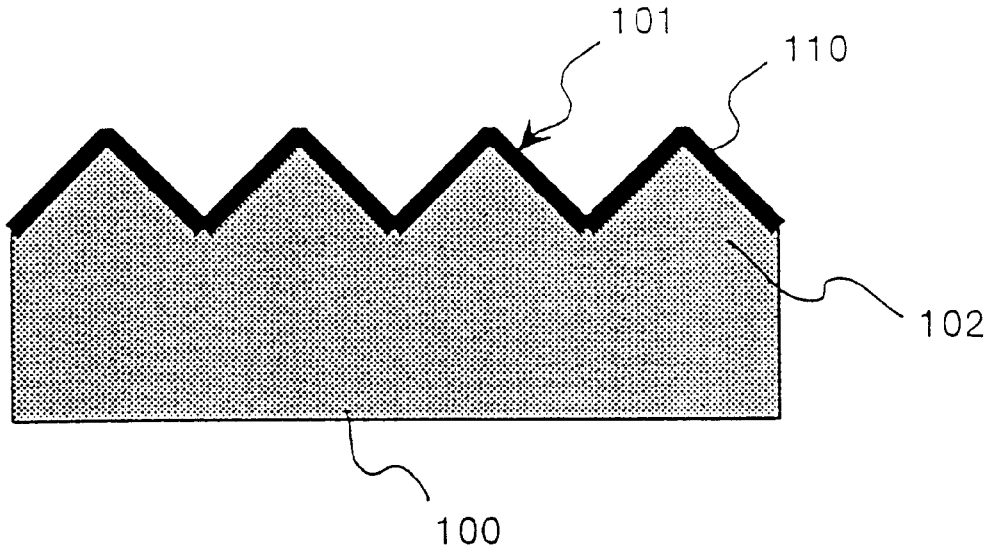
FIGS. 7(*a*) and (*b*) are enlarged cross-sectional views showing key parts of a rolling die according to other embodiment of the present invention.
Figure 7:
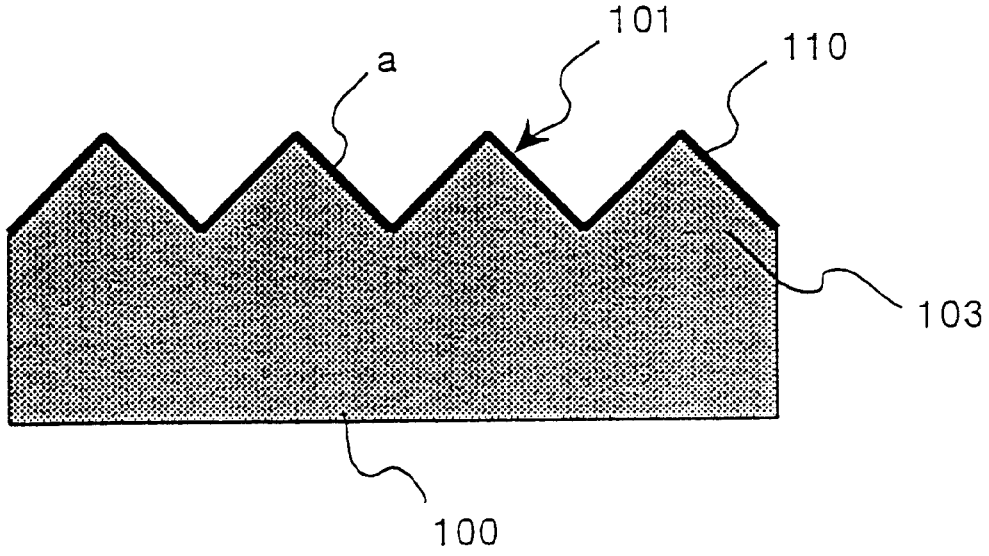

Based on the above-described discharge surface processing method according to the variable feeding-speed control, it is possible to obtain a rolling die in a state that the thickness of the hard film 110 is large at the bite-starting end 102 of a thread-rolled material and the thickness of the hard film 110 is gradually continuously smaller toward the rolling finishing end 103 along the rolling direction, as shown in FIGS. 7(*a*) and (*b*).

With the above arrangement, the rolling die is suitably provided with the abrasion-proof corresponding to the thickness of the hard film 110 in the rolling cutting-edge surface 101 by the hard film 110 without an excess or a shortage in the rolling direction according to the discharge surface processing method. At the same time, it is possible to reduce the surf ace processing time and to save resources of the electrode material, which results in a reduction in manufacturing cost.

Figure 8:
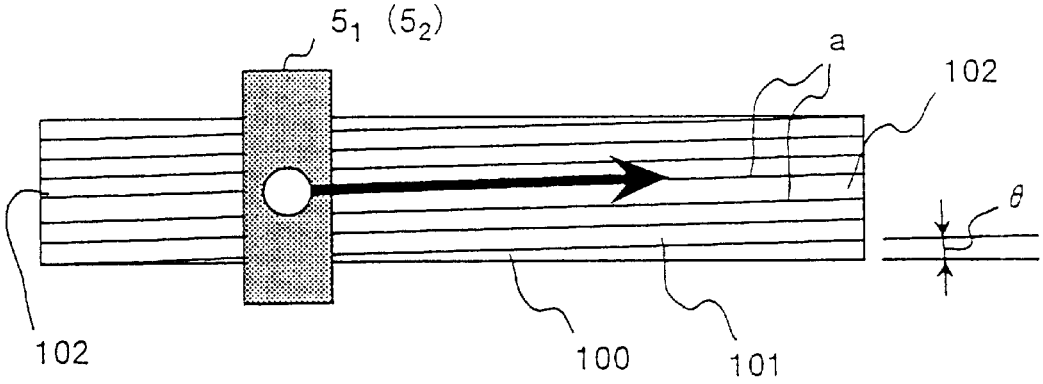
FIG. 8 is a top plan view showing one embodiment of a surface processing method for a rolling die according to the present invention.
Figure 9:
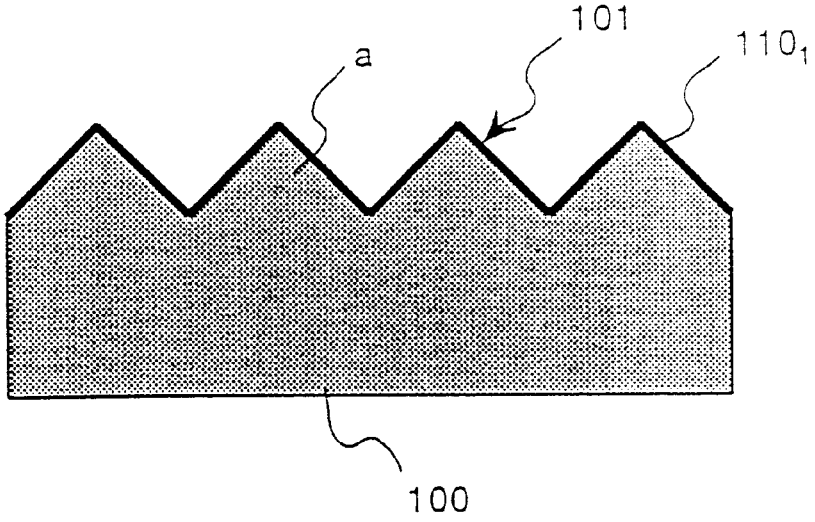
FIGS. 9(*a*) and (*b*) are enlarged cross-sectional views showing key parts of a rolling die according to other embodiment of the present invention.
Figure 9:
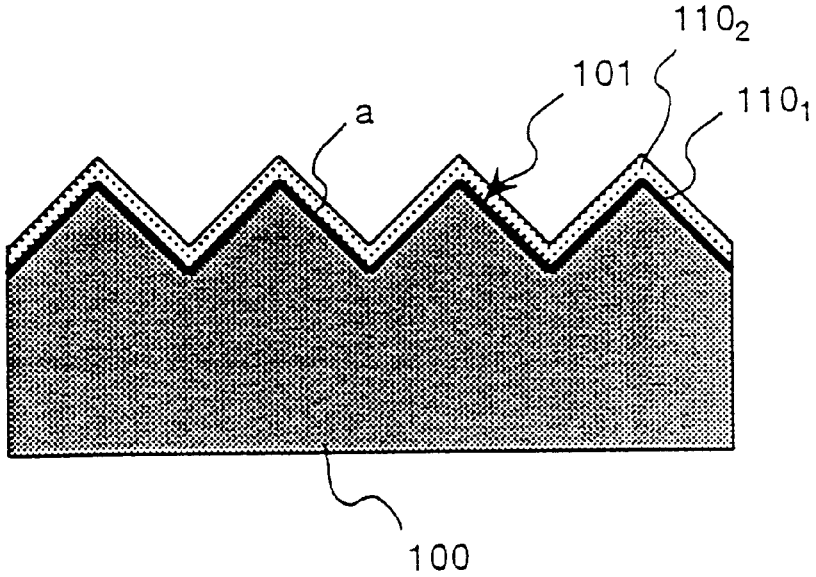

Further, as shown in FIG. 8, first, a discharge electrode $\mathbf{5}_1$ for a primary discharge surface processing and a rolling die material 100 are relatively moved to a longitudinal direction of ribbed projections a having an inclination at an inclination angle θ, and a discharging is generated between the rolling die material 100 and the discharge electrode $\mathbf{5}_1$ in the processing liquid as described above. An electrode exhaustion-melted substance or its reactive substance is generated by discharge energy based on this discharging, and this is adhered to and deposited onto a rolling cutting-edge surface 101 of the rolling die material 100. As a. result, as shown in FIG. 9(*a*), a primary hard film $\mathbf{110}_1$ of a primary material determined mostly by the material of the discharge electrode $\mathbf{5}_1$ for the primary discharge surface processing is formed on the rolling cutting-edge surface 101.

For the discharge electrode $\mathbf{5}_1$ to be used for the primary discharge surface processing for forming a primary hard film $\mathbf{110}_1$, it is possible to use a compressed-powder electrode that has been formed by a compression molding of a hard metal powder such as Ti, or a hard metal hydride powder such as $TiH_2$ (titanium hydride), or a mixture of other metal powder or ceramic material powder into these, in a similar manner to that of the above embodiment.

For the primary material for forming the primary hard film $\mathbf{110}_1$, there may be used a metal carbide such as WC, TiC, TaC, ZrC, SiC, VC, etc., or a nitride such as TiN, ZrN, etc., or a boride such as $TiB_2$, $ZrB_2$, etc., or a combination of these components.

Based on the above-described primary discharge surface processing, the primary hard film $\mathbf{110}_1$ having a predetermined thickness is formed on the rolling cutting-edge surface 101 of a rolling die material W. Upon completion of the primary discharge surface processing, next, a discharge electrode $\mathbf{5}_2$ (reference FIG. 8) for a secondary discharge surface processing and the rolling die material 100 are relatively moved to a longitudinal direction of ribbed projections a having the inclination at the inclination angle θ, and a discharging is generated between the rolling die material 100 and the discharge electrode $\mathbf{5}_2$, in a similar manner to that of the primary discharge surface processing. An electrode exhaustion-melted substance or its reactive substance is generated by discharge energy based on this discharging, and this is adhered to and deposited onto the primary hard film $\mathbf{110}_1$ of the rolling die material 100. As a result, as shown in FIG. 9(*b*), a secondary hard film $\mathbf{110}_2$ of a secondary material determined by the material of the discharge electrode $\mathbf{5}_2$ for the secondary discharge surface processing is formed on the primary hard film $\mathbf{110}_1$.

For the secondary material for forming the secondary hard film $\mathbf{110}_2$, there may be used a substance including either a simple substance or a mixture of a self-lubricant (solid lubricant) metal or a metal compound or molybdenum Mo, boron nitride BN, molybdenum dioxide $MoS_2$, graphite C, tungsten dioxide $WS_2$, etc.

The discharge electrode $\mathbf{5}_2$ to be used for the secondary discharge surface processing for forming the secondary hard film $\mathbf{110}_2$ is a discharge electrode different from the one used for the primary discharge surface processing. It is possible to use a compressed-powder electrode that has been formed by a compression molding of a powder of either a simple substance or a mixture of a self-lubricant metal or a metal compound, or other substance of molybdenum Mo, boron nitride BN, molybdenum dioxide $MoS_2$, graphite C, tungsten dioxide $WS_2$, etc.

In this case, oil or water is used as a liquid for the processing liquid. When a discharge surface processing is carried out using oil, carbide of an electrode component is formed by a reaction with carbon C in the oil based on discharge energy. The secondary hard film $\mathbf{110}_2$ becomes a material including carbide of a self-lubricant substance. The secondary hard film $\mathbf{110}_2$ of this substance has lower hardness than that of the metal carbide like TiC. However, as the secondary hard film $\mathbf{110}_2$ of this substance is provided with a solid lubricating function, this exhibits an effect of reducing frictional drag of the rolling cutting-edge surface onto which a large compressive load is applied at the time of the thread rolling.

The effect of reduction in the friction is estimated to work in the following mechanism. The secondary hard film $\mathbf{110}_2$ formed on the primary hard film $\mathbf{110}_1$ is provided on the film of an extremely high hardness. As the secondary hard film $\mathbf{110}_2$ has lower hardness than the primary hard film $\mathbf{110}_1$, a partial separation occurs when a compressive load works during the thread rolling. As a result, the secondary hard film $\mathbf{110}_2$ slides on the surface layer of the primary hard film $\mathbf{110}_1$ as the ground.

At this time, the functional film of the secondary processing (the secondary hard film $\mathbf{110}_2$) that drops in separation by being sandwiched between the material (the thread-rolled object) and the rolling die generates a lubrication work. This lubrication work protects the ground hard film (the primary hard film $\mathbf{110}_1$) and facilitates a plastic deformation of the rolling processing of the material, thereby reducing the load of the rolling and substantially lowering the rolling load that works on the rolling die. This protects the hard film of the primary processing for a long period. As the hardness is high, the base metal of the rolling die is protected.

The discharge surface processing has a large feature that it has a characteristic of an inclination functional material that a boundary layer between the base metal and the film changes continuously. Therefore, a hard film according to the discharge surface processing method by an in-liquid gap discharging has an extremely high adhesive strength although the film is the secondary hard film $\mathbf{110}_2$ provided on the crest portion. This film is not easily separated as compared with a film according to other method, and can maintain its effect for a long period. Therefore, it is better to have a double-structured hard film rather than a single hard film, in a construction having a hard film of a TiC metal carbide as the ground, with a carbide discharge surface processed film having a self-lubricating function on the ground film.

As explained above, it is possible to restrict the sliding of the material at the time of the thread rolling and to substantially improve the life of the die, by providing a discharge surface processing on the surface of the rolling die to have a double structure with a hard film of a TiC metal carbide formed as the ground and a carbide hard film of a self-lubricating function formed on the ground film.

When water is used for the processing liquid in the secondary discharge surface processing for forming the secondary hard film $\mathbf{110}_2$, there is not generated a carbide with a simple substance or a mixture of a self-lubricant metal or a metal compound, or other substance of molybdenum Mo, boron nitride BN, molybdenum dioxide $MoS_2$, graphite C, tungsten dioxide $WS_2$, etc. as the main component of the discharge electrode. The electrode component is sealed on the die surface as it is.

This is considered for the following reason. When a discharging is carried out in the oil, the carbon in the oil and the electrode component thermally react with each other to structure carbide. However, when a discharge surface processing is carried out in the processing liquid using water as a main component, this reaction process does not progress, and water is mixed with a metal molecule of the base metal simply in a thermally stirred state. This mixture is solidified and is deposited on the die surface.

A kind of a micro-stirred layer is generated on the surface of the base metal by the heat of the arc discharging, and the base metal is melted. At a stage of the solidification of a mixture of the melted base metal and the component of the electrode material, the component of the discharge electrode is taken in, and the mixture with the base metal is formed on the surface.

In this case, the hardness of the surface film of the mixed substance formed on the surface is not high as compared with that of a carbide. Instead, the surface film has the characteristic of the main component of the electrode main metal.

As the component of the discharge electrode $\mathbf{5}_2$ for the secondary discharge surface processing has self-lubricity, the mixed film formed on the base metal surface similarly has self-lubricity.

In this case too, the secondary hard film $\mathbf{110}_2$ formed on the primary hard film $\mathbf{110}_1$ is provided on the primary hard film $\mathbf{110}_1$ of an extremely high hardness. As described above, as the secondary hard film $\mathbf{110}_2$ has lower hardness than the primary hard film $\mathbf{110}_1$, a partial separation occurs when a compressive load works during the thread rolling. As a result, the secondary hard film $\mathbf{110}_2$ slides on the surface layer of the primary hard film $\mathbf{110}_1$ as the ground.

According, in this case too, the functional film of the secondary processing (the secondary hard film $\mathbf{110}_2$) that drops in separation by being sandwiched between the material (the thread-rolled object) and the rolling die generates a lubrication work. This lubrication work protects the ground hard film (the primary hard film $\mathbf{110}_1$) and facilitates a plastic deformation of the rolling processing of the material, thereby reducing the load of the rolling and substantially lowering the rolling load that works on the rolling die. This protects the hard film of the primary processing for a long period. As the hardness is high, the base metal of the rolling die is protected.

Further, in this case too, the discharge surface processing has a large feature that it has a characteristic of an inclination functional material that a boundary layer between the base metal and the film changes continuously. Therefore, a hard film according to the discharge surface processing has an extremely high adhesive strength although the film is the secondary hard film $\mathbf{110}_2$ provided on the crest portion. This film is not easily separated as compared with a film according to other method, and can maintain its effect for a long period. Therefore, it is better to have a double-structured hard film rather than a single hard film, in a construction having a hard film of a TiC metal carbide as the ground, with a discharge surface processed film of either a simple substance or a mixture with the base metal of a self-lubricant metal or a metal compound, or other substance of molybdenum Mo, boron nitride BN, molybdenum dioxide $MoS_2$, graphite C, tungsten dioxide $WS_2$, etc.

As explained above, it is possible to restrict the sliding of the material at the time of the thread rolling, decrease the rolling load, and to substantially improve the life of the die, by providing a discharge surface processing on the surface of the rolling die to have a double structure with a hard film of a TiC metal carbide formed as the ground and a discharge surface processed film of either a simple substance or a mixture with the base metal of a self-lubricant metal or a metal compound, or other substance of molybdenum Mo, boron nitride BN, molybdenum dioxide $MoS_2$, graphite C, tungsten dioxide $WS_2$, etc., on the ground.

INDUSTRIAL APPLICABILITY

As described above, the rolling die according to the present invention is suitable for a rolling processing of high-strength bolts or the like that use high-hardness and high-class materials.

What is claimed is:

1. A rolling die comprising:

a rolling die with a rolling cutting-edge surface;

an electrode exhaustion-melted substance or its reactive substance, which is generated during a discharging in a liquid, adhered to and deposited onto said rolling cutting-edge surface of said rolling die to form a hard film of the electrode exhaustion-melted substance or its reactive substance on said rolling cutting-edge surface, wherein the surface of said hard film at a bite-starting end of a thread-rolled material is rougher than the surface of said hard film toward a rolling finishing end along a rolling direction.

2. The rolling die according to claim 1, wherein said hard film is thicker at the bite-starting end of the thread-rolled material and thinner toward the rolling finishing end along the rolling direction.

3. The rolling die according to claim 1, wherein said hard film has a multi-layer and a multi-type material construction comprising:

a primary hard film made of a primary material formed on the rolling cutting-edge surface; and a secondary hard film made of a secondary material different from the primary material formed on the primary hard film.

4. The rolling die according to claim 3, wherein the primary hard film is formed of a hard metal carbide including WC, TiC, TaC, ZrC, SiC, or VC, and the secondary hard film is formed of (1) a self-lubricating metal (2) or a metal compound or (3) Mo, B, N, $MoS_2$, C, or $WS_2$.

5. A surface processing method for a rolling die comprising the steps of:

arranging a rolling die material and a discharge electrode opposite to each other in a processing liquid with a predetermined discharge gap between the rolling die material and the discharge electrode;

generating an electric discharge between the rolling die material and the discharge electrode to produce an electrode exhaustion-melted substance or its reactive substance;

depositing the electrode exhaustion-melted substance or its reactive substance onto a rolling cutting-edge surface of the rolling die material to form a hard film on the rolling cutting-edge surface, wherein said generating step is performed while relatively moving the discharge electrode along a long-axis direction of projections on the rolling cutting edge surface.

6. The surface processing method for a rolling die according to claim 5, further comprising the step of:

maintaining a processing condition such that a shape of the rolling cutting-edge surface of the rolling die material is copied onto an opposite surface of the discharge electrode as the formation of the hard film progresses, wherein (1) the discharge electrode has a plane surface as an initial shape facing the rolling die material, and (2) has a predetermined width in a relative movement direction with respect to the rolling die material.

7. The surface processing method for a rolling die according to claim 5, wherein the surface of the hard film at the bite-starting end of the thread-rolled material is rougher than the surface of the hard film toward the rolling finishing end along the rolling direction.

8. The surface processing method for a rolling die according to claim 7, wherein (1) the hard film at the bite-starting end of the thread-rolled material is achieved by setting a predetermined discharge processing current, and (2) the hard film toward the rolling finishing end is achieved by setting another discharge processing current that is lower than the predetermined discharge processing current.

9. The surface processing method for a rolling die according to claim 5, wherein a thickness of the hard film at a bite-starting end of the thread-rolled material is greater than a thickness of the hard film toward the rolling finishing end along the rolling direction.

10. The surface processing method for a rolling die according to claim 9, wherein the hard film is formed by (1) setting a predetermined feeding speed at the bite starting end of the thread rolled material, and (2) setting another feeding speed, which is faster than the predetermined feeding speed, toward the rolling finishing end.

11. The surface processing method for a rolling die according to claim 5, wherein the rolling cutting-edge surface is covered with a hard film of a multi-layer and multi-type material construction by first forming a primary hard film made of a primary material on the rolling cutting-edge surface using a discharge electrode, and thereafter forming a secondary hard film made of a secondary material, which is different than the primary material, on the primary hard film using a discharge electrode.

12. The surface processing method for a rolling die according to claim 11, wherein the secondary hard film is formed by using (1) a discharge electrode including (a) a self-lubricant metal, or (b) a metal compound, or (c) Mo, B, N, $MoS_2$, C, or $WS_2$, and (2) a processing liquid having oil as a main component.

13. The surface processing method for a rolling die according to claim 11, wherein the secondary hard film is formed by using (1) a discharge electrode including (a) a self-lubricant metal, or (2) a metal compound, or (3) Mo, B, N, $MoS_2$, C, or $WS_2$, and (2) a processing liquid having water as a main component.

* * * * *